US008599648B1

(12) United States Patent
Butler et al.

(10) Patent No.: US 8,599,648 B1
(45) Date of Patent: Dec. 3, 2013

(54) DOUBLY STEERED ACOUSTIC ARRAY

(75) Inventors: John L. Butler, Cohasset, MA (US); Alexander L. Butler, Weymouth, MA (US)

(73) Assignee: Image Acoustics, Inc., Cohasset, MA (US)

( * ) Notice: Subject to any disclaimer, the term of this patent is extended or adjusted under 35 U.S.C. 154(b) by 0 days.

(21) Appl. No.: 13/464,103

(22) Filed: May 4, 2012

Related U.S. Application Data

(60) Provisional application No. 61/577,307, filed on Dec. 19, 2011.

(51) Int. Cl.
*G10K 11/32* (2006.01)
*G10K 11/34* (2006.01)

(52) U.S. Cl.
CPC ..... *G10K 11/345* (2013.01)
USPC ..... 367/138

(58) Field of Classification Search
USPC ..... 367/138
See application file for complete search history.

(56) References Cited

U.S. PATENT DOCUMENTS

| | | | | |
|---|---|---|---|---|
| 4,332,986 | A | 6/1982 | Butler | |
| 4,742,499 | A | 5/1988 | Butler | |
| 4,754,441 | A | 6/1988 | Butler | |
| 4,845,688 | A | 7/1989 | Butler | |
| 4,864,548 | A | 9/1989 | Butler | |
| 5,047,683 | A | 9/1991 | Butler et al. | |
| 5,184,332 | A | 2/1993 | Butler | |
| 6,734,604 | B2 | 5/2004 | Butler et al. | |
| 6,950,373 | B2 | 9/2005 | Butler et al. | |
| 7,292,503 | B2 | 11/2007 | Butler et al. | |
| 7,372,776 | B2 | 5/2008 | Butler et al. | |
| 7,453,186 | B1 | 11/2008 | Butler et al. | |
| 7,692,363 | B2 | 4/2010 | Butler et al. | |
| 2003/0227826 | A1 * | 12/2003 | Butler et al. | 367/164 |
| 2004/0228216 | A1 * | 11/2004 | Butler et al. | 367/141 |
| 2007/0195647 | A1 * | 8/2007 | Butler et al. | 367/153 |
| 2007/0230277 | A1 * | 10/2007 | Butler et al. | 367/163 |
| 2008/0079331 | A1 * | 4/2008 | Butler et al. | 310/331 |

OTHER PUBLICATIONS

L. Butler, A. L. Butler and J. A. Rice, "A tri-modal directional transducer," J. Acoust. Soc. Am. 115, 658-665 (Feb. 2004).
J. L. Butler, A. L. Butler and S. C. Butler, The modal Projector, J. Acoust. Soc. Am. 129, 1881-1889 ( Apr. 2011).
L. Butler and J. L. Butler, "The octoid modal vector projector," (A) J. Acoust. Soc. Am., 130, 2505 (Oct. 2011).

* cited by examiner

*Primary Examiner* — Isam Alsomiri
*Assistant Examiner* — James Hulka
(74) *Attorney, Agent, or Firm* — David M. Driscoll, Esq.

(57) ABSTRACT

A modal piezoelectric transducer that is constructed with at least three multi section piezoelectric structures to which a shell with equal concave or indentation sections is attached at the intersections of the piezoelectric structures providing magnified displacement to attached pistons and greater loading of the medium on to the piezoelectric structures producing greater output and a lower resonance frequency. A doubly steered array of steerable modal piezoelectric transducers is steered in the same direction as the array is steered.

29 Claims, 8 Drawing Sheets

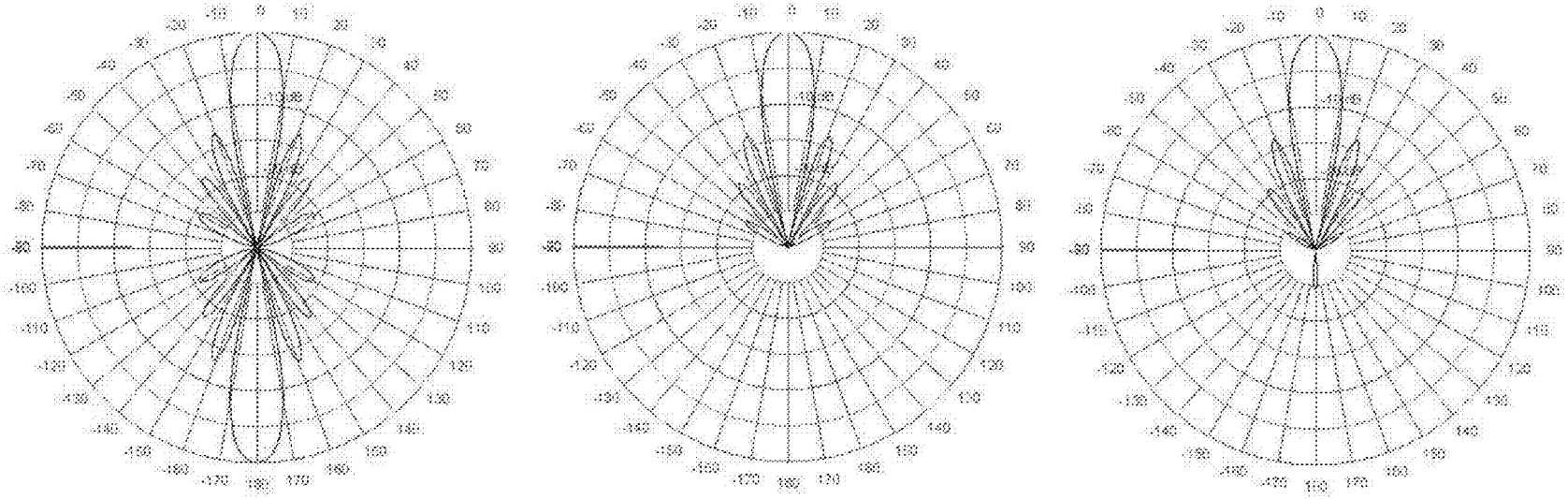
Fig. 4A
Fig. 4B
Fig. 4C
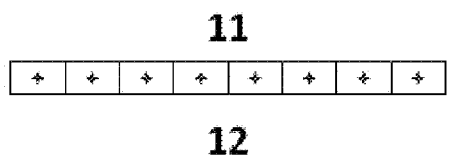
Fig. 4D
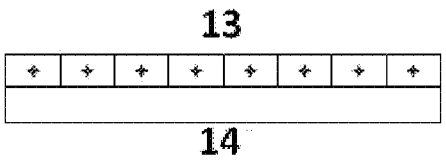
Fig. 4E
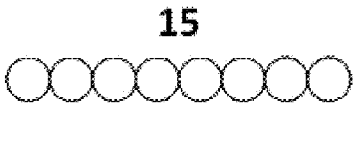
Fig. 4F

DOUBLY STEERED ACOUSTIC ARRAY

RELATED CASE

Priority for this application is hereby claimed under 35 U.S.C. §119(e) to commonly owned and U.S. Provisional Patent Application No. 61/577,307 which was filed on Dec. 19, 2011 and which is incorporated by reference herein in its entirety.

FIELD OF THE INVENTION

The present invention relates in general to arrays of acoustic transducers, and pertains more particularly to arrays of transducer elements and a modal vector projector element which can be steered in the general direction of the steered array resulting in improved array source level and beam pattern performance.

BACKGROUND OF THE INVENTION

Arrays of acoustic transducers typically use elements with fixed beam patterns oriented in the un-steered direction of the array, as in the broadside direction of a planar array. Under steered conditions the source level will be less than the un-steered case if the array elements have a fixed beam pattern structure with maximum performance in the un-steered broadside direction. This is of particular note when a planar or line array is steered 90° from the broadside direction toward the end-fire direction. Another common problem associated with arrays of transducers is related to so-called grating or alias lobes where a side lobe is of the same source level as the main lobe, as in the case of small elements spaced one wavelength apart. Of particular interest is the typical array with center-to-center spacing of one half-wavelength which, if steered to end-fire, will also be automatically steered in the opposite direction. Quarter wavelength spacing with smaller array elements could be used to achieve single ended end-fire steering; however, in this case there could be less output as the array elements would be small and there could be interaction problems. These undesirable array steered conditions can be mitigated with the use of larger steered directional elements as described in this invention. As the center-to-center spacing is increased to one-half wavelength, the element size can be increased allowing the use of half as many transducer elements as in the case of the quarter wavelength spaced array.

Accordingly, it is an object of the present invention to provide an improved steered array source level and beam structure by use of steerable array elements.

Another object of the present invention is to provide unidirectional end-fire steering with half-wavelength center-to-center spaced steerable elements.

Another object of the present invention is to provide a steered acoustic transducer array with 360 degree coverage around a planar array.

Still another object of the present invention is a steerable modal vector projector transducer element with a small enough size for half wavelength array spacing at resonance.

BRIEF SUMMARY OF THE INVENTION

To accomplish the foregoing and other objects, features and advantages of the present invention there is provided a modal piezoelectric transducer that is comprised of at least three multi section piezoelectric structures to which a shell with equal concave or indentation sections is attached at the intersections of the piezoelectric structures providing magnified displacement to attached pistons and greater loading of the medium on to the piezoelectric structures producing greater output and a lower resonance frequency.

In accordance with other aspects of the present invention the radiating pistons are attached to the shell at the concave or indentation locations of maximum motion and use shell leveraging magnification to yield a smaller sized resonator; operating in the monopole, dipole or quadrupole modes of operation separately or simultaneously and can be steered by incrementing its voltage distribution; and in which the piezoelectric structure is in the form of a triangle, square, hexagon or octagon or higher order structure.

Another version of the present invention is a modal piezoelectric ring or cylinder structure to which a shell with equal concave or indentation sections attached at the intersections of the piezoelectric electrode sections providing magnified displacement to attached pistons and greater loading of the medium on to the piezoelectric sections as well as a lower resonance frequency.

In still another embodiment an array of acoustic transducers can be steered in the general direction that the array is steered providing improved source level and improved beam pattern structure. Associated aspects include wherein the array is in the form of a line, a plane, a cylinder, a sphere or a spheroid; the transducers have center-to-center spacing of approximately one-half or greater wavelength of the surrounding medium; the array can be steered to end-fire without a significant rear lobe level; the array operates as a projector of sound or as a receiver of sound; the array operates in a fluid such as water, or a gas such as air or in a solid such as a plastic, ceramic or metal; using a modal transducer as an element of the array and which generates a steerable beam that can be directed in the general direction of the steered array; with elements steered to 45° and 45° increments; which uses the monopole, dipole and quadrupole modes to generate a steerable directional beam pattern, or which uses higher order modes; and wherein the transducers are constructed of piezoelectric or magnetostrictive materials.

In accordance with the present invention there is also provided a modal piezoelectric transducer comprising: a shell that includes a plurality of adjacently disposed indentation sections; a plurality of piezoelectric members supported within the shell with adjacent piezoelectric members being interconnected by a bridge means; and a piston disposed in each indentation and driven from oppositely disposed lever arms of the shell. The activation of the piezoelectric members provides magnified displacement to the pistons and greater loading of the medium to provide enhanced output at a lower resonance frequency. In one embodiment described herein the bridge means comprises a bridge member upon which a fixed section of the shell is mounted. In another embodiment the piezoelectric members are formed as a continuous ring, and the bridge means comprises a margin (gap) between adjacent piezoelectric members, with the shell including a support piece disposed at each margin.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which:

FIGS. 4A and 4B shows array beam pattern for eight conventional un-steered dual and single sided array elements while FIG. 4C shows the array beam pattern for eight steered array elements all with one-half wavelength center-to-center spacing and un-steered at 0°, in the broadside direction;

FIGS. 4D, 4E and 4F respectively illustrate the half wavelength spaced array configuration for conventional un-steered dual sided and single sided arrays and array of steerable array elements.

FIGS. 5A and 5B shows array beam pattern for eight conventional un-steered dual and single sided array elements respectively while

FIGS. 6A and 6B shows array beam pattern for eight conventional un-steered dual and single sided array elements respectively while

FIGS. 7A and 7B shows array beam pattern for eight conventional un-steered dual and single sided array elements respectively while FIGS. 8A and 8B shows array beam pattern for eight conventional un-steered dual and single sided array elements respectively while

DETAILED DESCRIPTION

Figure 1A:
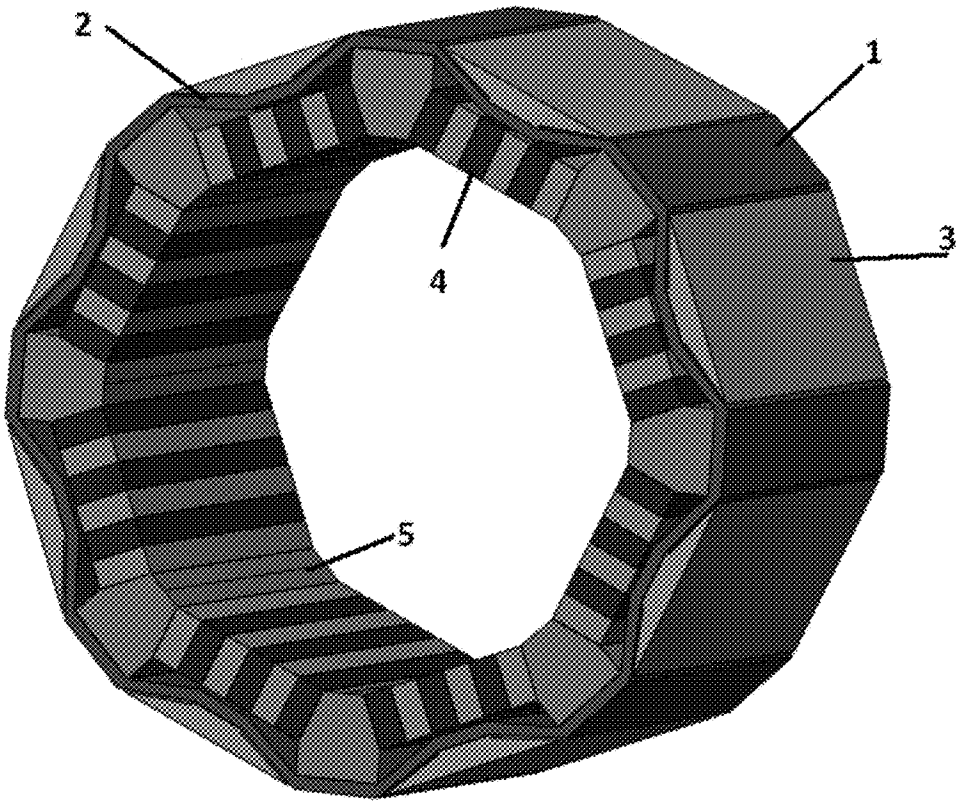
FIG. 1A shows an octagonal ring of piezoelectric stacks with attached leveraging shell and pistons attached at the location of maximum motion.

The following is a detailed description of this doubly steered array in which the elements of the array are steered in the general direction in which the array is steered. Normally arrays are steered relative to the center of the transducer element radiating or receiving surface. The array is then phased shifted so that the radiation (or reception) adds at the steered angle in the same way it adds in the un-steered broadside direction. However, because of directional characteristics of typical elements the steered response is reduced and the beam pattern structure is altered. In the present invention the transducers are additionally steered to be directed in the same direction as the array is steered.

A preferred steerable array element is the modal acoustic transducer [2, 4, 5, 6] vector projector or sensor along with size modification means [1, 3, 7]. In addition to these transducers an octagonal ring element with shell 1 and eight pistons 3 is introduced here and fully shown in FIG. 1A and also shown as one-eighth section in FIG. 1B. In operation the eight piezoelectric sections 4 expand and contract under AC electric fields causing the lateral distance in the direction 6 to increase and decrease in size with the octagonal ring. This motion is transferred to motion in the radial direction 7 along with the shell 1 also now moving in the radial direction 7 with increased displacement. This increase in the effective circumference of the shell 1 causes the eight indented lever arms 2 (which are effectively part of the shell) of the shell, at angle σ, to move with magnified motion causing the pistons 3 to also move with the magnified motion.

Figure 1B:
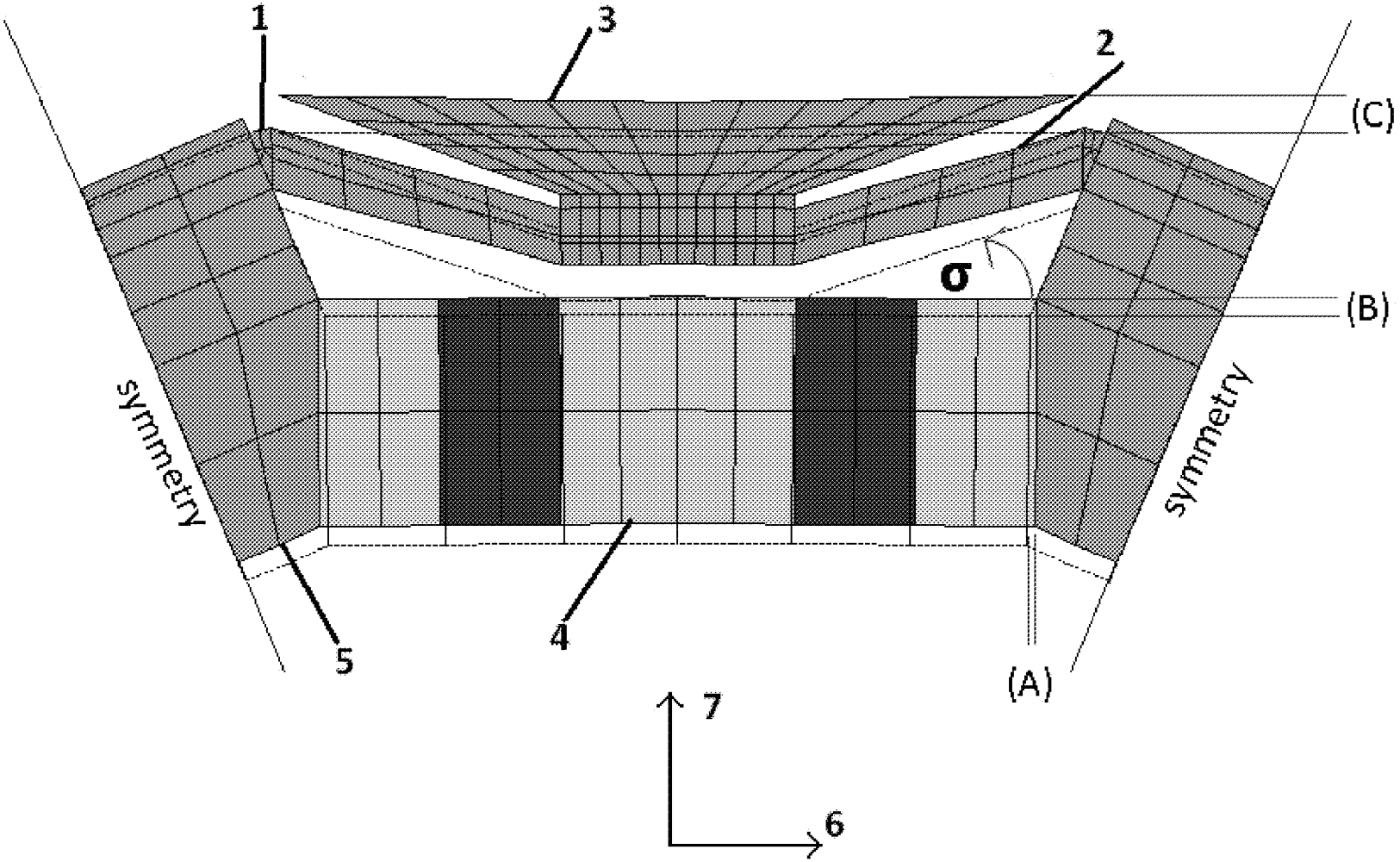
FIG. 1B shows a finite element one-eighth symmetry model with displacements A, B, and C of the octagonal ring structure of FIG. 1A with leverage arm inclination angle σ.

Thus, in FIGS. 1A and 1B there is identified a ring like shell 1 that is disposed about the piezoelectric transducers 4 with each transducer 4 linked by respective bridge members 5. A substantially flat shell section is illustrated overlying each of the bridge members 5. In a sense the shell structure continues in the area over each transducer 4 to form respective lever arms 2 that couple between the flat shell sections and to which is attached a respective piston 3. FIG. 1B in particular illustrates further details of a one-eighth section. Forms of excitation of the piezoelectric stacks are known and described in further detail hereinafter.

Refer now also to FIG. 1B for the motions generated. This motion illustrated in FIG. 1B is a ⅛ finite element symmetry model with piezoelectric stack displacement increase (A), stack radial displacement increase (B) and radial displacement (C) of the piston 3 with the shell leverage arm angle given by σ. The piston magnification factor may then be written as $$M=C/A=(B/A)(C/B) \tag{1}$$

The magnification is the product of the radial magnification of the octagonal ring, B/A, and the magnification of the lever arm C/B. The finite element results are B/A 2.25 and C/B=2.0 yielding a magnification of M=4.5 for this configuration. A trigonometry solution may also be obtained and written as $$M=1/\tan\alpha+1/\tan\sigma=\sin(\sigma+\alpha)/\sin\sigma\sin\alpha \tag{2}$$

where α=180/N, N is the number of sections to the ring and σ is the leverage arm angle, as before. In this particular octagonal case N=8, α=22.5° and σ=27° leading to a comparable magnification of 4.4. This displacement magnification also works in reverse and creates a greater load on the piezoelectric by a factor $M^2$ and magnifies the piston and radiation mass as well as the radiation resistance yielding a lower wide band resonance.

Although the pistons can yield more acoustic output, through their uniform motion and a lower resonance frequency, this modal transducer can be also used with the shell but without the pistons and also may be designed with as little as N=3 sections. In the case of the doubly steered array this octagonal ring transducer would be the preferred design as it resonates at low frequency and the size is approximately one-half wavelength in-water at resonance making it ideal for usage in acoustic arrays.

Figure 1C:
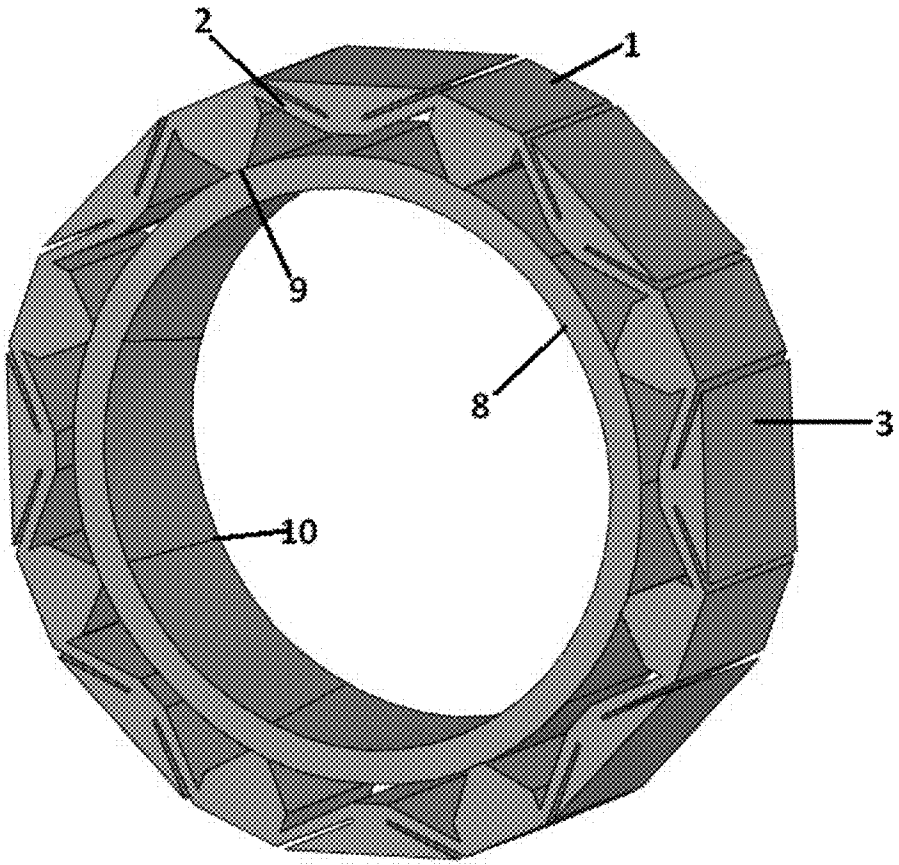
FIG. 1C shows a continuous piezoelectric ring with attached leveraging shell and pistons attached at the location of maximum motion.

An alternative lower cost structure is illustrated in FIG. 1C where a continuous piezoelectric ring 8 replaces the eight piezoelectric stacks of the octagonal structure and is in contact with the shell 1 through the spaced apart supports 9. Each of the supports 9 actually contact the ring 8 at equally spaced locations about the ring 8. The ring is shown with eight margins or gaps 10 on the electrode surface allowing the piezoelectric 31 mode of excitation of the monopole, dipole and quadrupole modes and also allowing incremental steering every 45°. The use of more and wider margins allows excitation of the piezoelectric ring in the higher coupled piezoelectric 33 mode of operation.

Figure 2:
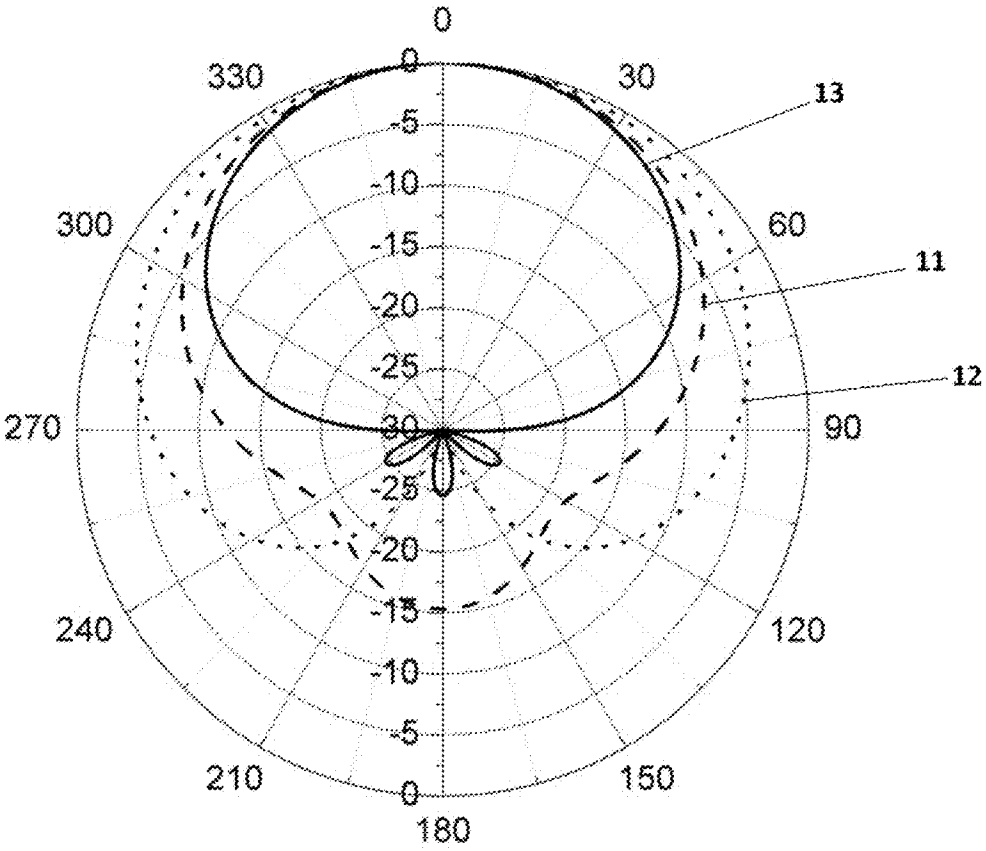
FIG. 2 shows three sample beam patterns that can be generated from a modal vector transducer and used as elements of a doubly steered array in accordance with the present invention.

A polar graph of three beam patterns from a modal transducer element of an array is illustrated in FIG. 2. These element patterns may be steered in the general direction that the array is steered and produce steerable directional beam patterns by combining the monopole, dipole and quadrupole modes of this transducer together in various proportions and by incrementing this voltage distribution for steering. The resulting element beam pattern function for the first three modes may be written as:

$$F_e(\theta)=[1+A_1\cos\theta+A_2\cos 2\theta]/[1+A_1+A_2] \quad (3)$$

where $A_1$ is the weighting factor of the dipole mode, $A_2$ is the weighting factor for the quadrupole mode and the weighting factor of the omni monopole mode, $A_0$, is set equal to unity. In the process of creating a beam pattern, the dipole and quadrupole mode voltages are adjusted so their phase and amplitudes match the phase and amplitudes of the monopole mode and then the weighting factors are applied. The synthesis of pattern 11 (dashed line), obtained with $A_1=1$ and $A_2=0.414$ is illustrated in FIG. 2. This pattern is shown along with the classic cardioid pattern 12 (dotted line) with $A_1=1$ and $A_2=0$ and an even more directional pattern 13 (solid line) with $A_1=1.6$ and $A_2=0.8$. We note that a comparable pattern to that of 13 would be the case with $A_1=2$ and $A_2=1$ yielding a similar pattern but with a null at 180° as well as at 90° and 270° at the expense of slightly higher back lobes. The beam patterns of FIG. 2 may be steered every 45° by simply incrementing voltage distribution on eight electrodes of a cylindrical transducer. With the beam steerable to a direction $\theta_s$, Eq. (3) may be written as:

$$F_e(\theta,\theta_s)=[1+A_1\cos(\theta-\theta_s)+A_2\cos 2(\theta-\theta_s)]/[1+A_1+A_2] \quad (4)$$

The overall array beam pattern, $F(\theta)$, obeys the product theorem, which is the product of the modal element beam patterns, $F_e(\theta)$, and the array beam pattern, $F_a(\theta)$, for point sources replacing the elements. That is:

$$F(\theta)=F_e(\theta)F_a(\theta) \quad (5)$$

If a tri-modal element is used, the element beam pattern function is given by Eq. (4). If a steered line array is used or if a planar array is steered in the same direction, the array equivalent point source beam pattern function may be written as:

$$F_a(\theta)=\sin(Nx)/N\sin x \quad (6)$$

where $$x=(\pi s/\lambda)(\sin\theta-\sin\theta_s) \quad (7)$$

and s is the center-to-center spacing, λ, is the wavelength in the medium, θ is the angle from the broadside direction and $\theta_s$ is the angle to which the array beam is steered to.

If a conventional un-steered uniform line or rectangular transducer elements of length L<=s is used, instead of the steerable modal element, the element beam pattern function is $$F_e(\theta)=\sin(y)/y \quad (8)$$

where y is given by $$y=(\pi L/\lambda)(\sin\theta) \quad (9)$$

Accordingly, the conventional array beam pattern function for a line array is $$F(\theta)=[\sin(y)/y][\sin(Nx)/N\sin x] \quad (10)$$

The above line or rectangular element function sin (y)/y may be replaced by the beam pattern function for a circular piston, should that be the case, and either may be used to represent dual sided transducers that radiate in both directions. It may also be augmented with the product of the cardioid function, (1+cos θ)/2, to include the case of single sided radiation as in the case of a planar array of tonpilz piston transducers.

If the element size is small compared to the wavelength of sound in the medium such that y<<1, the element beam pattern directionality will be omni-directional and there will be no affect on the array beam pattern as here sin (y)/y≈1. However, in this case there will be less output or sensitivity from the array as the elements would be small. If the array were packed with many small elements there could be interaction problems.

On the other hand, with the element beam pattern function of the invention we have $$F(\theta)=[F_e(\theta,\theta_s)][\sin(Nx)/N\sin x] \quad (11)$$

where the element pattern function, $F_e(\theta,\theta_s)$, is given by Eq. (4) if transducer tri-modal elements are used instead of conventional uniform elements of length L, allowing element steering into the direction of the array steering.

Equation (10) with fully packed array, with L=s, and Eq. (10) also with the single sided factor (1+cos θ)/2) have been evaluated and compared with the steered element results of Eq. (11). Cases of array center-to-center spacing of one-half wavelength (s=λ/2) un-steered at θ° and steered at 45°, 90°, 180° and −90° (270° have been considered to illustrate the improvements provided by this steered element invention. The acoustic levels of the graphs are in dB=20 log |F (θ)|.

Figure 3C:
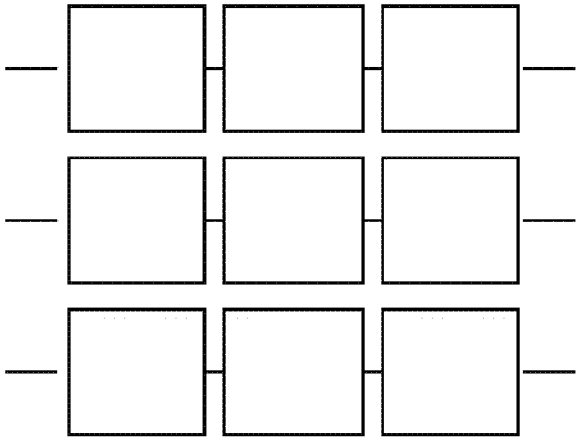
FIGS. 3A, 3B and 3C shows three arrays structures using vector project modal transducer elements with three elements coaxially stacked in FIG. 3A, three elements arranged as line array in FIG. 3B and three coaxial stacked elements as a planar array of three stacked elements.
Figure 3B:
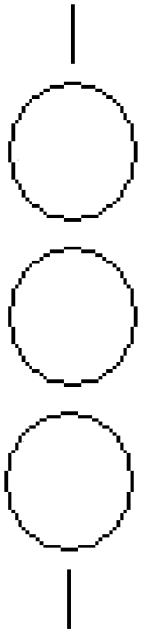
Figure 3A:
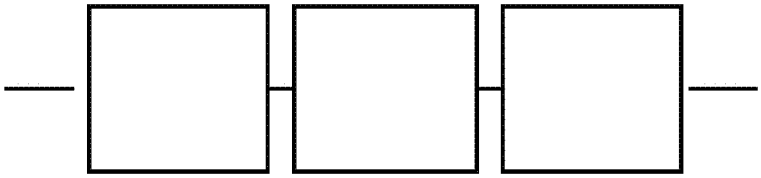

FIGS. 3A, 3B and 3C shows three array structures using vector project modal transducer elements with three elements coaxially stacked in FIG. 3A, three elements arranged as line array in FIG. 3B and three coaxial stacked elements as a planar array of three stacked elements.

As indicated before, in the present invention there is provided an acoustic array of steerable transducer elements that provide improved steered beam source level and beam pattern structure all accomplished with acoustical array elements that are electronically steered into the general direction in which the array is steered. For other examples of transducer structures that may be used in connection with the present invention refer to the following issued patents and publications. These documents also illustrate various transducer structures and means for excitation of these structures. All of the following issued patents and publications are hereby incorporated by reference herein in their entirety.

Patents:

[1] J. L. Butler, "Flextensional Transducer," U.S. Pat. No. 4,864,548, Sep. 5, 1989. [2] J. L. Butler and A. L. Butler, "Multimode Synthesized Beam Transduction Apparatus," U.S. Pat. No. 6,734,604 B2, May 11, 2004. [3] A. L. Butler and J. L. Butler, "Multi Piston Electro-Mechanical Transduction Apparatus," U.S. Pat. No. 7,292,503 B2, Nov. 6, 2007. [4] A. L. Butler and J. L. ButlerFor, "Modal Acoustic Array Transduction Apparatus," U.S. Pat. No. 7,372,776 B2, May 13, 2008.

Publications:

[5] J. L. Butler, A. L. Butler and J. A. Rice, "A tri-modal directional transducer," J. Acoust. Soc. Am. 115, 658-665 (2004). [6] J. L. Butler, A. L. Butler and S. C. Butler, "The modal Projector, J. Acoust. Soc. Am. 129, (2011), [7] A. L. Butler and J. L. Butler, "The octoid modal vector projector," (A) J. Acoust. Soc. Am., 130, 2505 (2011).

The case of one-half wavelength center-to-center spacing as illustrated in FIGS. 4A through 8C where A represent conventional results from Eq. (10), for a dual sided radiator, such as the case for a line array or planar array of flexural or flextensional transducer, B represent results of a single sided transducers, (such as a housed tonpilz piston transducer planar array and C represents the results of the present invention of steered elements based on Eq. (11) for either a planar or line array. We have selected modal coefficients $A_1$=1.6 and $A_2$0.8 with beam pattern 13 of FIG. 2 for these half-wavelength spaced cases. FIGS. 4D, 4C and 4D illustrate the eight element array with elements for dual radiation 11 and 12, single side radiation 13 with no radiation on the other side 14 and adjustable steered beam radiation 15 from all sides and ends. FIGS. 4A, 4B and 4C represent the respective broadside beam un-steered patterns with steering angle $\theta_s=\theta°$.

Figure 5A:
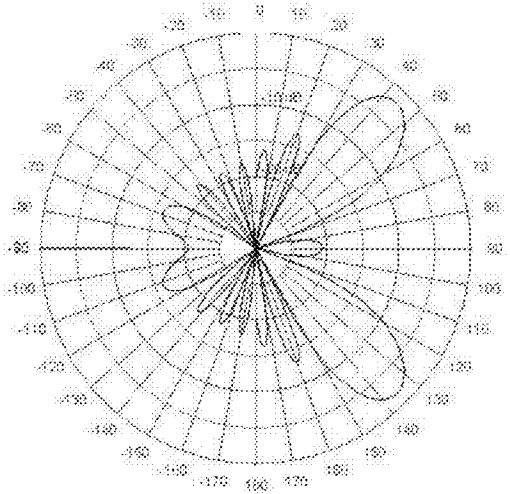
Figure 5B:
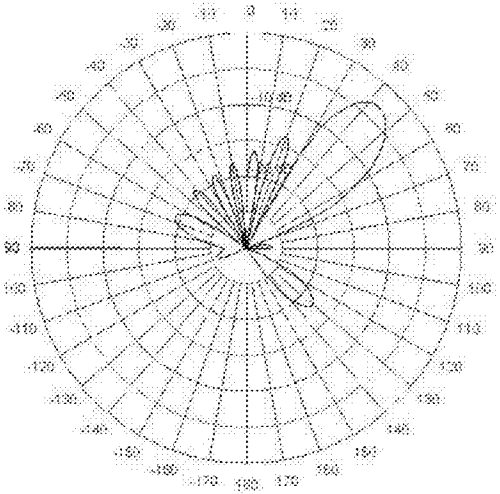
Figure 5C:
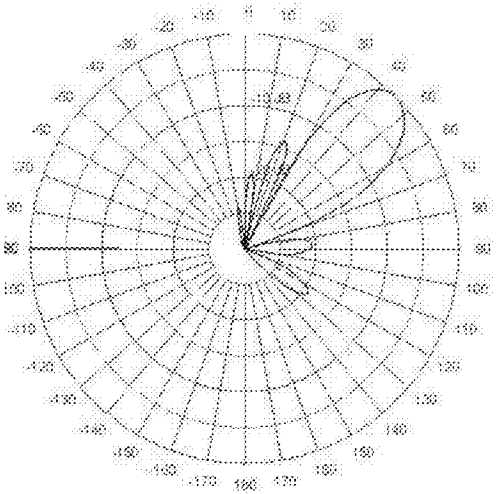
FIG. 5C shows the array beam pattern for eight additionally steered array elements all with one-half wavelength center-to-center spacing and steered at 45°.
Figure 6A:
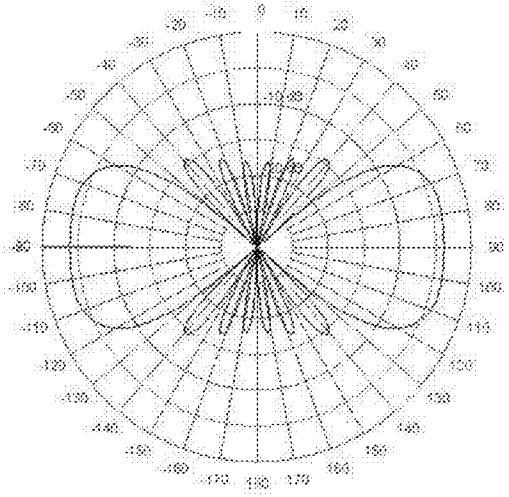
Figure 6B:
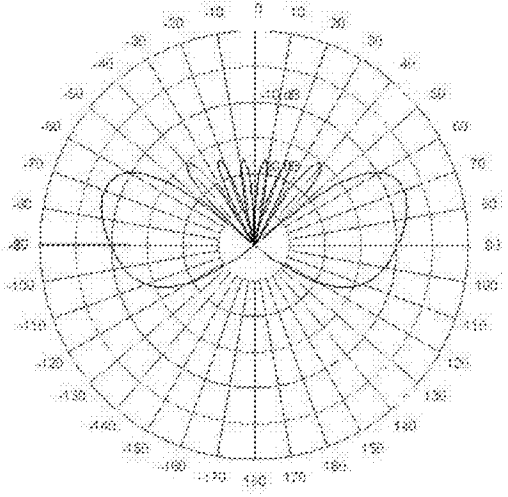
Figure 6C:
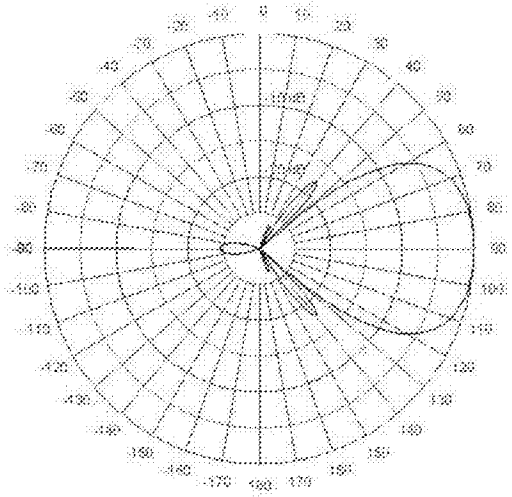
FIG. 6C shows the array beam pattern for eight steered array elements all with one-half wavelength center-to-center spacing and steered at 90° end fire direction.
Figure 8A:
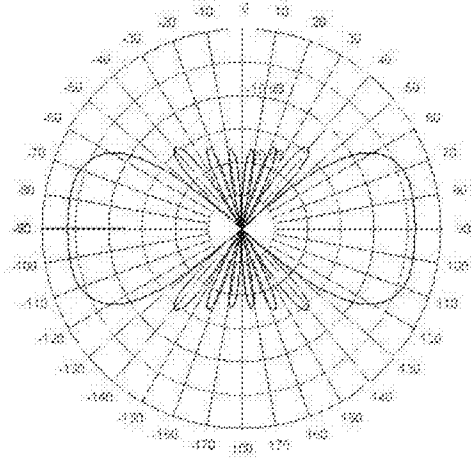
Figure 8B:
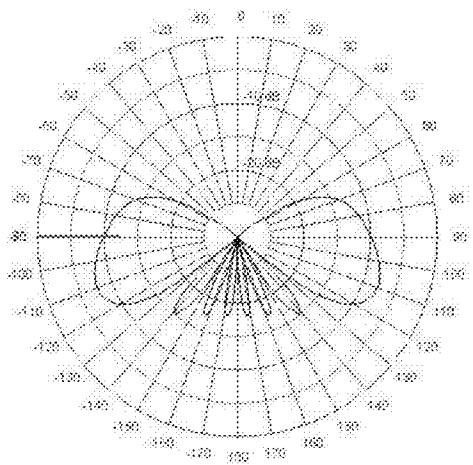
Figure 8C:
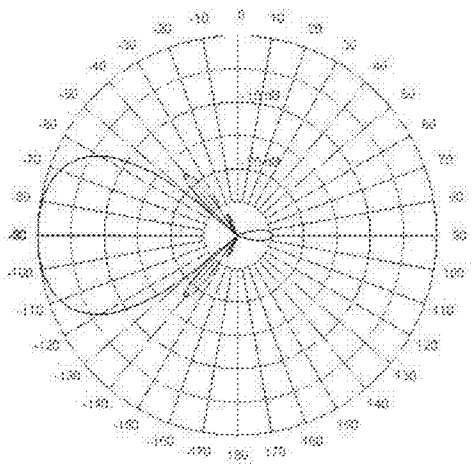
FIG. 8C shows the array beam pattern for eight steered array elements all with one-half wavelength center-to-center spacing and steered to −90° (270°).

More importantly are the beams if the array were steered to, say, $\theta_s$=45° as shown in FIGS. 5A, 5B and 5C. As seen, there is there is a reduction in level of 2 and 3 dB for the conventional cases of FIGS. 5A and 5B respectively but no reduction in level for the steered element array of FIG. 5C., This is seen to a greater extent at the steered angles of 90° and −90° where here the steered modal result of FIGS. 6C and 8C show no reduction but the conventional un-steered case of FIGS. 6A, 6B, 8A and 8B show a reduction in level of 4 and 10 dB. Moreover, in this case of end-fire steering the modal steered case of FIG. 6C shows only a slight back lobe at −90°, as desired, while the un-steered conventional case of FIGS. 6A and 8A shows a strong back lobe that is not a result of symmetry conditions but a result of attempted end-fire steering with half-wavelength center-to-center separation creating a grating lobe in this case.

Figure 7A:
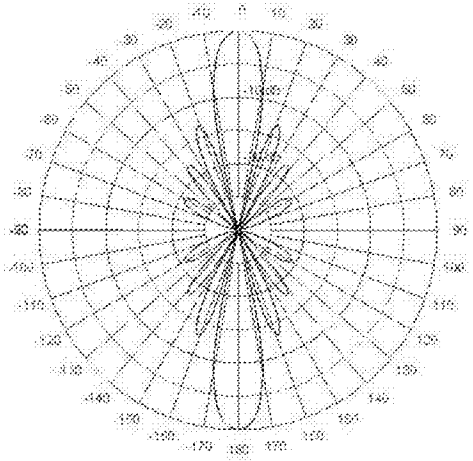
Figure 7B:
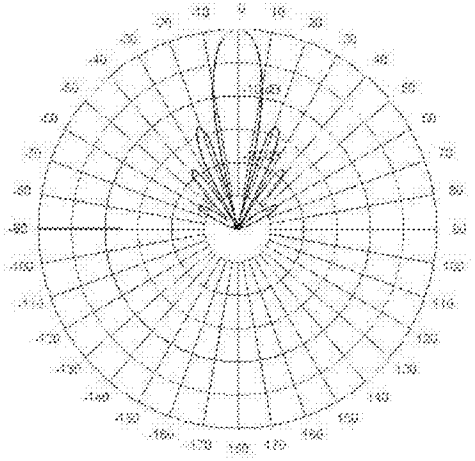
Figure 7C:
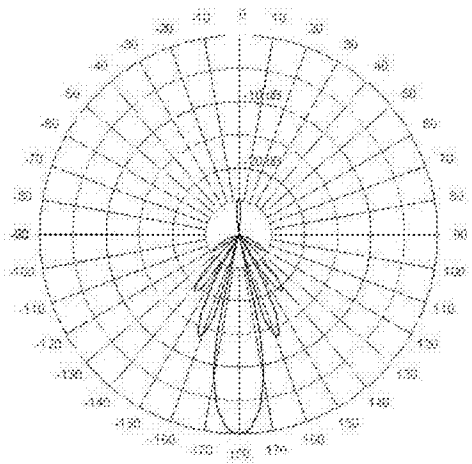
FIG. 7C shows the array beam pattern for eight steered array elements all with one-half wavelength center-to-center spacing and steered to 180°.

For the arrays steered to 180°, FIG. 7A shows a dual beam, FIG. 7B shows a beam in the wrong direction while FIG. 7C show the desired steered beam. FIGS. 8A and 8B shows the array with conventional transducer elements steered to −90° (270°) with reduced dual sided pattern. On the other hand, with the modal steered vector projector elements there is only a single major beam direction toward −90° and at full level.

We should note that if there is a desire to steer only in the range from 0° to ±90° then single ended conventional tonpilz piston transducers could be used without the back lobe at 180° as shown in FIG. 4A. However, even in this case there will be a large back lobe in the end fire case of FIG. 6A as a result of the half wavelength center to center spacing and necessary phase reversal steering to achieve end fire. In the case of steerable elements, there will be no significant back lobe as shown in FIG. 6C. Again showing the steered element cases yield significantly improved array performance. Although we have illustrated the invention with half wavelength center-to-center spacing, even greater comparative improvements can be obtained at larger separations.

As may be seen, the modal steered beam elements of our invention yields greater output in the steered direction and better front-to-back ratio allowing end-fire steering with no (or largely reduced) back lobe with half-wavelength center-to-center separation. Without this invention one-quarter wavelength center-to-center spacing (or less) of the array elements would be required for end-fire steering in one direction. A tri-modal modal transducer has been presented as the steerable transducer of the array. A modal transducer with higher order modes than the quadrupole mode could also be used to attain an even narrower beam pattern.

Having now described a limited number of embodiments of the present invention, it should become apparent to those skilled in the art that numerous other embodiments and modifications thereof are contemplated as falling within the scope of the present invention as defined in the appended claims.

What is claimed is:

1. A modal piezoelectric transducer comprising:

a shell that is in the form of a closed ring member that includes a plurality of adjacently disposed indentation sections and a plurality of intermediate sections that respectively interconnects adjacent indentation sections;

a plurality of piezoelectric members and a plurality of bridge members that are together in the form of a closed piezoelectric ring structure, said plurality of piezoelectric members and plurality of bridge members supported within said shell with adjacent piezoelectric members being interconnected by a respective bridge member;

each said shell indentation section comprised of a lever arm that is coupled between adjacent intermediate sections of said shell;

a radiating piston attached to each lever arm of the shell;

each said shell intermediate section comprised of a fixed section that is mounted to the bridge member; and means for the activation of the piezoelectric members providing magnified displacement to said pistons and greater loading of the medium to provide enhanced output at a lower resonance frequency.

2. The piezoelectric transducer of claim 1 wherein said intermediate section of the shell is comprised of a flat section.

3. The piezoelectric transducer of claim 1 wherein each lever arm comprises separate arm sections with the piston supported between the arm sections.

4. The piezoelectric transducer of claim 3 wherein the piezoelectric members are driven in a first direction and correspondingly the lever arm and piston is driven in a second direction that is substantially orthogonal to the first direction.

5. The piezoelectric transducer of claim 1 wherein said piezoelectric members are formed as a continuous ring having a margin (gap) between adjacent piezoelectric members, and said shell intermediate sections each includes a support piece disposed at each margin.

6. The piezoelectric transducer of claim 5 wherein each lever arm comprises separate arm sections with the piston supported between the arm sections.

7. The piezoelectric transducer of claim 6 wherein the piezoelectric members are driven in a first direction and correspondingly the lever arm and piston is driven in a second direction that is substantially orthogonal to the first direction.

8. The piezoelectric transducer of claim 1 that operates in the monopole, dipole or quadrupole modes of operation separately or simultaneously and can be steered by incrementing its voltage distribution.

9. The piezoelectric transducer of claim 1 in which the piezoelectric structure is in the form of a triangle, square, hexagon or octagon or higher order structure.

10. The piezoelectric transducer of claim 1 wherein the transducers are constructed of piezoelectric or magnetostrictive materials.

11. The piezoelectric transducer of claim 1 wherein the radiating pistons are each attached to a center of the lever arm.

12. The piezoelectric transducer of claim 1 wherein the piezoelectric members have center-to-center spacing of approximately one-half or greater wavelength of the surrounding medium.

13. The piezoelectric transducer of claim 1 wherein the piezoelectric transducer can be steered to end-fire without a significant rear lobe level.

14. The piezoelectric transducer of claim 1 wherein the piezoelectric transducer operates as a projector of sound or as a receiver of sound.

15. The piezoelectric transducer of claim 1 wherein the piezoelectric transducer operates in a fluid such as water, or a gas such as air or in a solid such as a plastic, ceramic or metal.

16. The piezoelectric transducer of claim 1 which generates a steerable beam that can be directed in the general direction of the steered array.

17. The piezoelectric transducer of claim 16 wherein the steerable beam is steered to 45° and 90°.

18. A modal piezoelectric transducer comprising:

a shell that is in the form of a closed ring member that includes a plurality of adjacently disposed indentation sections and a plurality of intermediate sections that respectively interconnects adjacent indentation sections;

a continuous and closed piezoelectric ring having a plurality of spaced apart gaps;

each said shell indentation section comprised of a lever arm that is coupled between adjacent intermediate sections of said shell;

a radiating piston attached to each lever arm of the shell;

each said shell intermediate section comprised of a support member that is in contact with the continuous piezoelectric ring at the defined gap; and means for the activation of the piezoelectric members providing magnified displacement to said pistons and greater loading of the medium to provide enhanced output at a lower resonance frequency.

19. The piezoelectric transducer of claim 18 wherein the radiating pistons are each attached to a center of the lever arm.

20. The piezoelectric transducer of claim 18 wherein the piezoelectric transducer can be steered to end-fire without a significant rear lobe level.

21. The piezoelectric transducer of claim 18 wherein the piezoelectric transducer operates as a projector of sound or as a receiver of sound.

22. The piezoelectric transducer of claim 18 wherein the piezoelectric transducer operates in a fluid such as water, or a gas such as air or in a solid such as a plastic, ceramic or metal.

23. The piezoelectric transducer of claim 18 which generates a steerable beam that can be directed in the general direction of the steered array.

24. The piezoelectric transducer of claim 23 wherein the steerable beam is steered to 45° and 90°.

25. The piezoelectric transducer of claim 18 wherein each lever arm comprises separate arm sections with the piston supported between the arm sections.

26. The piezoelectric transducer of claim 25 wherein the piezoelectric ring is driven in a first direction and correspondingly the lever arm and piston is driven in a second direction that is substantially orthogonal to the first direction.

27. The piezoelectric transducer of claim 18 that operates in the monopole, dipole or quadrupole modes of operation separately or simultaneously and can be steered by incrementing its voltage distribution.

28. The piezoelectric transducer of claim 18 in which the piezoelectric ring is in the form of a triangle, square, hexagon or octagon or higher order structure.

29. The piezoelectric transducer of claim 18 wherein the piezoelectric ring is constructed of piezoelectric or magnetostrictive materials.

* * * * *